US007665822B2

(12) United States Patent
Aoki

(10) Patent No.: US 7,665,822 B2
(45) Date of Patent: Feb. 23, 2010

(54) INK JET RECORDING APPARATUS

(75) Inventor: Katsuko Aoki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 358 days.

(21) Appl. No.: 11/263,071

(22) Filed: Oct. 31, 2005

(65) Prior Publication Data

US 2006/0181568 A1 Aug. 17, 2006

(30) Foreign Application Priority Data

Nov. 2, 2004 (JP) ..... P.2004-318818

(51) Int. Cl.
*B41J 2/165* (2006.01)

(52) U.S. Cl. ..... 347/29

(58) Field of Classification Search ..... 347/29–32
See application file for complete search history.

(56) References Cited

U.S. PATENT DOCUMENTS

| | | | | |
|---|---|---|---|---|
| 5,563,640 | A * | 10/1996 | Suzuki | 347/45 |
| 5,670,997 | A * | 9/1997 | Sugimoto et al. | 347/30 |
| 6,938,986 | B2 * | 9/2005 | Macler et al. | 347/45 |
| 2002/0109744 | A1 * | 8/2002 | Shindo | 347/23 |
| 2006/0181568 | A1 * | 8/2006 | Aoki | 347/30 |

FOREIGN PATENT DOCUMENTS

| | | |
|---|---|---|
| JP | 4-294145 | 10/1992 |
| JP | 7-117242 | 5/1995 |
| JP | 7-290724 | 11/1995 |

OTHER PUBLICATIONS

Computer-Generated English Translation of Claims and Specification and Patent Abstracts of Japan of JP 7-290724 dated Nov. 7, 1995.
Computer-Generated English Translation of Claims and Specification and Patent Abstracts of Japan of JP 7-117242 dated May 9, 1995.
Patent Abstracts of Japan of JP 4-294145 dated Oct. 19, 1992.

* cited by examiner

*Primary Examiner*—Stephen D Meier
*Assistant Examiner*—Alexander C Witkowski
(74) *Attorney, Agent, or Firm*—Ladas and Parry LLP

(57) ABSTRACT

The present invention provides an ink jet recording apparatus having an ink jet recording head provided with a plurality of nozzles through which inks of a plurality of colors are ejected, a cap to be detachably brought into close contact with a nozzle face in which holes of the plurality of nozzles are formed, and ink-suction means which sucks an ink within the ink jet recording head by way of the cap. The apparatus is configured such that contact angles θa of the inks with respect to the nozzle face and contact angles θb of the inks with respect to the cap have a relation of θa>θb; and the angles θa are 50° or larger, and differences between the angles θa and the angles θb are 40° or larger.

3 Claims, 4 Drawing Sheets

INK JET RECORDING APPARATUS

FIELD OF THE INVENTION

The present invention relates to a color recording apparatus of an ink jet recording system which ejects ink, in the form of droplets, onto a recording paper, or the like, thereby attaining recording. More particularly, the invention relates to a color ink jet recording apparatus provided with a recording head for ejecting inks of a plurality of colors, the ink jet recording apparatus being provided with a cleaning mechanism for providing initial filling of ink, for recovery from nozzle clogging, or the like purpose.

BACKGROUND OF THE INVENTION

An ink jet recording apparatus ejects ink droplets while reciprocating a recording head for ejecting ink laterally in a state of having a short distance from a recording medium, thereby forming on the recording medium characters or an image in accordance with image data, to thus attain recording. By means of changing the color of ink to be ejected, color printing is enabled; and by means of employing inks of three colors of yellow, magenta, and cyan, full-color recording can also be readily attained. As compared with recording in black on the basis of color mixing of yellow, magenta and cyan inks, recording in black with use of a black ink is superior in terms of reduction of recording time, as well as in terms of the density of a recorded color. Therefore, four colors including the black ink are more often employed for full-color recording.

Means for miniaturization of a color ink jet recording apparatus which performs recording of a color image by ejecting inks of different colors through predetermined nozzles includes employment of a "multi-color-integrated recording head". The multi-color-integrated recording head ejects inks of different colors from a single recording head. The multi-color-integrated recording head performs recording while grouping nozzles for the respective colors. When the nozzle groups are provided respectively for yellow, magenta, cyan, and black, full-color recording can be attained by use of the single recording head.

An ink jet recording apparatus ejects liquid ink. Accordingly, when moisture and other volatile constituents evaporate from the liquid ink, the viscosity of the ink increases. (Hereinafter, increase in viscosity caused by evaporation of moisture and other volatile constituents is referred to as "thickening".) The thus-thickened ink causes nozzle clogging, thereby causing faulty ejection of ink. In ink jet recording of recent years, an amount of an ink droplet ejected for forming a record is of a submicroscopic size of several pL so as to achieve high-definition recording. Hence, nozzles through which inks are ejected are reduced in diameter, and energy required for ink ejection is also reduced. Since the nozzles are small in diameter, and are also small in terms of energy for ejecting ink, influences exerted on ink ejection by nozzle clogging are significant. In addition, in some cases, bubbles are trapped within the nozzles or ink supply paths, thereby rendering the condition inappropriate for ejection. Furthermore, paper, which makes up the majority of recording media for ink jet printing, produces a large amount of paper dust through a sheet feeding operation associated with recording. In some cases, the thus-produced paper dust, ambient dust, and a trace amount of small ink droplets which are produced along with ejection of ink droplets adhere to a face where the nozzles are formed (hereinafter called as a "nozzle face") of a recording head through which inks are ejected.

When foreign substances constituted of ink, paper dust, dust, and the like adhere to the nozzles and to the vicinity thereof, normal ejection of ink is inhibited.

Recovery means must be provided so as to prevent or resolve faulty ejection resulting from thickening of ink, bubble entrapment, and adhesion of foreign substances onto the nozzle face. In many cases, suction means and wipe-cleaning means are employed in combination as the recovery means. The suction means attains recovery by means of pressing a cap, which is provided with an air-communication port having a valve for establishing communication with the air, against the nozzle face, thereby forcibly sucking ink, to thus discharge ink, bubbles, foreign substances, and the like, clogged in the nozzles to the outside of the nozzles. The wipe-cleaning means wipes and cleans the nozzle face through a wiping operation of bringing a blade-like wiping member (hereinafter called a "wiper") into close contact with the nozzle face of the recording head, and moving the wiper and the nozzle face in relation to each other. The ink adhering to the nozzle face as a result of the suction operation is removed from the nozzle face by the wipe-cleaning means. Hereinafter, a recovery operation making use of the recovery means is called "cleaning."

When ink has been filled in a recording head prior to use of an ink jet recording apparatus, ink may be leaked during the course of distribution and storage. Therefore, ink is not filled in a recording head before distribution and storage. Upon first use, ink is sucked from an ink-retaining mechanism to the ink supply path and to the recording head, to thus be filled, in an initial filling operation. In this case, the ink suction means is also used as filling means. Furthermore, the wiping and cleaning operations are also performed so as to make the condition conducive to favorable ejection.

In actual recovery procedures, the cap is brought into close contact with the nozzle face so as to cover the nozzles of the recording head. Thereafter, ink is sucked by means of building up negative pressure within the cap by use of a suction device. As a result of this suction, ink is accumulated within the cap. Subsequently, the space within the cap is brought into communication with the air, and suction is performed again by use of the suction device, thereby discharging the ink within the cap. When the ink within the cap is successfully removed, the cap is removed. Next, the wiper is placed on the head to thus perform wiping, thereby removing unnecessary ink adhering to the vicinity of the nozzles. Subsequently, the cap is brought into close contact with the nozzle face again, and pre-ejection (flushing) of ejecting ink out of all the nozzles is performed, thereby forming ink meniscuses. After micro-bubbles and color-mixed ink in the nozzles are discharged, the cap is removed from the nozzle face. Cleaning is selectively implemented for a variety of causes (such as elapse of a given amount of time from a previous cleaning operation, or forcible cleaning which is performed upon occurrence of faulty ejection). Therefore, the amount of ink to be sucked, the number of times of wiping, and the number of flushing operations to be performed are not uniform. However, since flushing after wiping is performed for bringing the nozzles into the condition conducive to favorable ejection, the flushing is performed under substantially identical conditions irrespective of a variety of cleaning modes.

However, cleaning of a multi-color-integrated recording head involves a problem, which arises irregularly during ink suction, that ink sucked via a nozzle through a suction operation intrudes into another nozzle for another color. This problem is caused by uncontrollable causes, such as an irregular flow of ink within a cap, or the like. When ink of a different color intrudes into the nozzle, the colors of inks are mixed.

When the color-mixed ink is ejected out of the nozzle, obtainment of desired recording colors on a recording medium fails. To this end, a color ink jet recording apparatus must be provided with a countermeasure for preventing color mixing on a nozzle face. In addition, the number of flushing operations for ejecting the color-mixed ink must be set in accordance with an extent of color mixing.

When ink easily wets the nozzle face in ink jet recording, the ink is spread on the nozzle face, which results in non-ejection of ink droplets. Alternatively, even when ink droplets are ejected, the ink droplets vary in size, velocity, or direction of ejection by a significant extent, thereby failing to obtain stable ejection. To this end, attempts have been made to reduce the wettability of the nozzle face against the ink, to thereby obtain stable ejection. As materials for forming an ink jet head, there have been employed silicon, glass, metals, resins, and the like, which have the property of being readily wet with ink. Hence, a method of forming a water-repellent film on the nozzle face has been proposed as a method for reducing wettability. (Patent Document 1)

As a method for resolving nozzle clogging, there has been proposed a method for cleaning a recording head, which is characterized in that both a contact angle θ1 between ink and an inner surface of a cap, and a contact angle θ2 between a nozzle face and the ink are set to 90° or smaller, where θ2≦θ1. More specifically, according to the cleaning method, clogging is recovered as follows. Both the inner surface of the cap, and the nozzle face are made to be readily wet with ink. When ink is discharged to the cap through the nozzles by a cleaning operation, the ink spreads on the cap and the nozzle face, and covers the clogged nozzles. Hence, the clog is dissolved by the ink. (Patent Document 2)

As a method for preventing color mixing of inks in nozzles which may be otherwise caused by cleaning, there has been proposed an ink jet recording apparatus. The apparatus is characterized in that its multi-color-integrated recording head has a structure, within a cap for use in ink suction, for causing inks of respective colors to flow more readily in a direction crossing a direction along which the nozzles are aligned than in the direction along which the nozzles are aligned. (Patent Document 3)

[Patent Document 1] JP-A-4-294145

[Patent Document 2] JP-A-7-290724

[Patent Document 3] JP-A-7-117242

According to the method of spreading ink on the nozzle face, thereby dissolving nozzle clogs, to thus recover the clogged nozzles, ink having been sucked into the cap during cleaning readily wets both the cap and the nozzle face. Hence, the ink on the nozzle face is likely to be uneven. Furthermore, the ink becomes further uneven as a result of wiping and cleaning during a wiping operation, which can result in unstable ejection of the ink. In order to stabilize ink ejection, the nozzle face must be wetted uniformly with ink by means of strictly adjusting a suction force for ink, the number of times and strength of the wiping operation, and the like. As a result, a period of time for cleaning becomes inevitably long, and the cleaning operation is inevitably complicated. In addition, since a load applied on a wiper during the wiping operation must be increased, durability of an ink-repellent film on the nozzle face is decreased. Furthermore, in the case where cleaning for inks of a plurality of colors is implemented, color mixing of inks occurs at the nozzles. Consequently, an amount of ink required for flushing for resolving the color mixing is increased.

A method of forming grooves in an absorptive member within the cap, a method of forming the cap from a multilayered sponge-like member, and the like, have been proposed as means for providing the structure for causing the ink to flow more readily in the direction crossing the direction along which the nozzles are aligned than in the direction along which the nozzles are aligned. When the clearances between different colors are reduced, disposition of the structure, which is to be disposed between different ink colors, for causing ink to readily, accurately flow between nozzles of different colors encounters difficulty, thereby inhibiting miniaturization of the head. Furthermore, since microprocessing must be applied on the absorptive member within the cap, cost is increased.

SUMMARY OF THE INVENTION

More specifically, the invention aims at reducing cost related to recording, and eliminating a cost increase related to cleaning by means of the following: the amount of ink remaining on a nozzle face after suction of ink into a cap through a head is reduced; accordingly, the degree of color mixing of the ink, a period of time required for a cleaning operation, and the number of flushing operations for resolving the color mixing are reduced, thereby increasing the amount of ink which can be used for recording.

Other objects and effects of the invention will become apparent from the following descriptions.

The above object is attained by the following means.

An ink jet recording apparatus having an ink jet recording head provided with a plurality of nozzles through which inks of a plurality of colors are ejected, a cap to be detachably brought into close contact with a nozzle face in which holes of the plurality of nozzles are formed, and ink suction means which sucks an ink within the ink jet recording head by way of the cap, is configured such that a contact angle θa of the ink with respect to the nozzle face and a contact angle θb of the ink with respect to the cap has a relation of θa>θb. According to the configuration, the ink adhering to the nozzle face is readily removed from the nozzle face and readily adheres to the cap. Therefore, when inks of a plurality of different colors are sucked simultaneously, the ink spreads less readily on the cap, and readily moves to the cap. Accordingly, the ink remains less readily on the nozzle face. Since different colors remain on the nozzle face less readily, the amount of ink intruding into the nozzles during a wiping operation, which is performed subsequent to the suction operation, is reduced. Therefore, color mixing occurs less readily. As a result, the number of flushing operations for resolving the color mixing can be reduced.

Furthermore, the ink jet recording apparatus of the invention is configured such that the angle θa is 50° or larger, and a difference between the angle θa and the angle θb is 40° or larger. According to the configuration, the degree of color mixing can be ascertained to be small in advance. Hence, the number of required flushing operations can be readily predicted, thereby obviating provision of an excessive margin in setting of the number of flushing operations to be performed subsequent to wiping. Furthermore, ink can be wiped sufficiently even when a load applied on the wiper during wiping is small. Therefore, the durability of the ink-repellent film on the nozzle face can be increased without disposition of special means.

1: ink jet recording apparatus, 2: carriage, 3: recording head, 4: actuation mechanism, 5: head maintenance unit, 6: ink suction mechanism, 7: ink-wiping mechanism, 11: recording paper serving as a recording medium, 31: nozzles, 32: nozzle face, 61: cap, 62: inner absorptive member, 63: ink tube, and 71: wiper

DETAILED DESCRIPTION OF THE INVENTION

Configuration of Printer

The configuration of an ink jet recording apparatus according to the invention will now be described.

Overall Configuration

Figure 1:
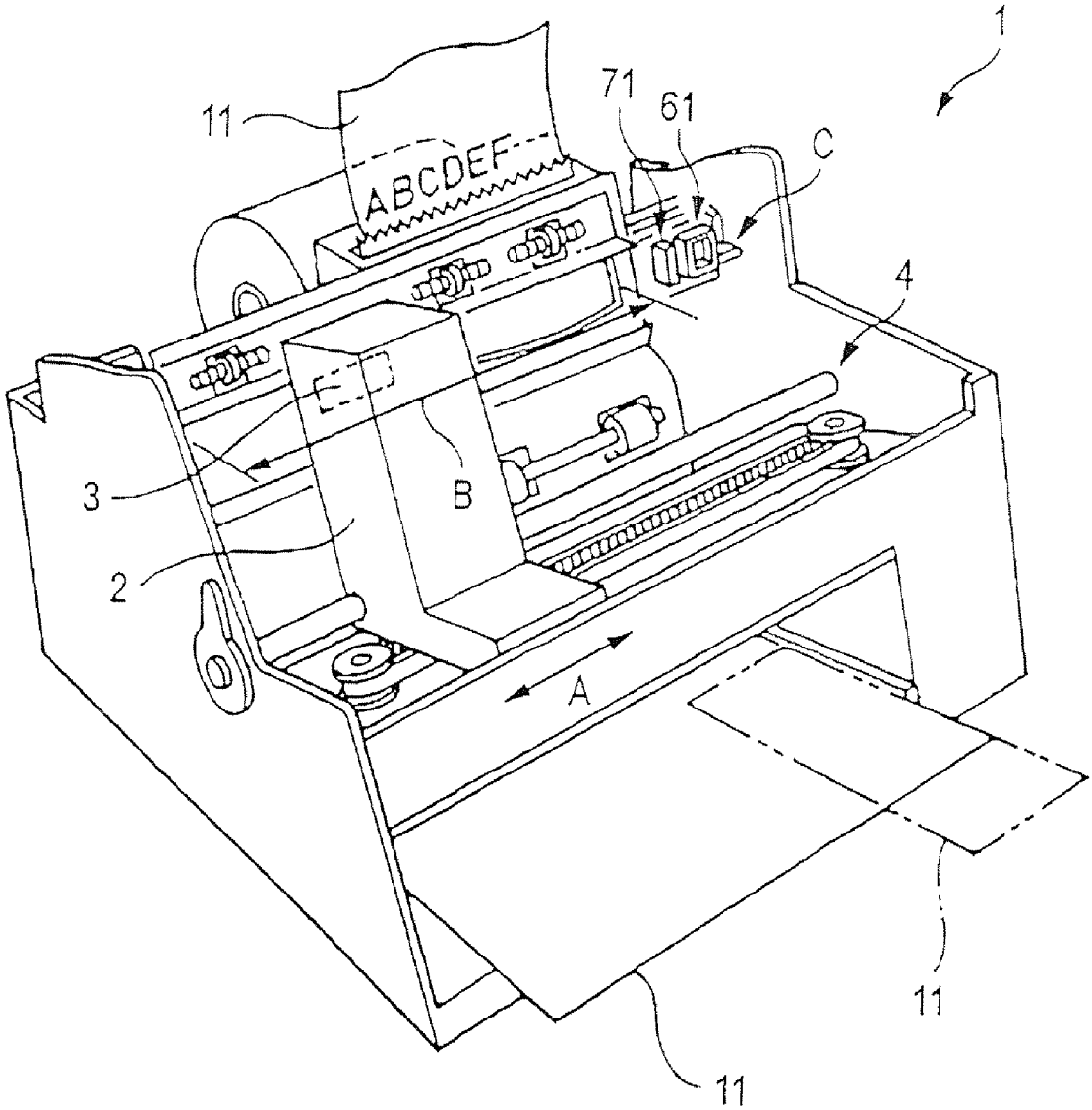
FIG. 1 is a perspective view of an ink jet recording apparatus to which the present invention is applied.
Figure 2:
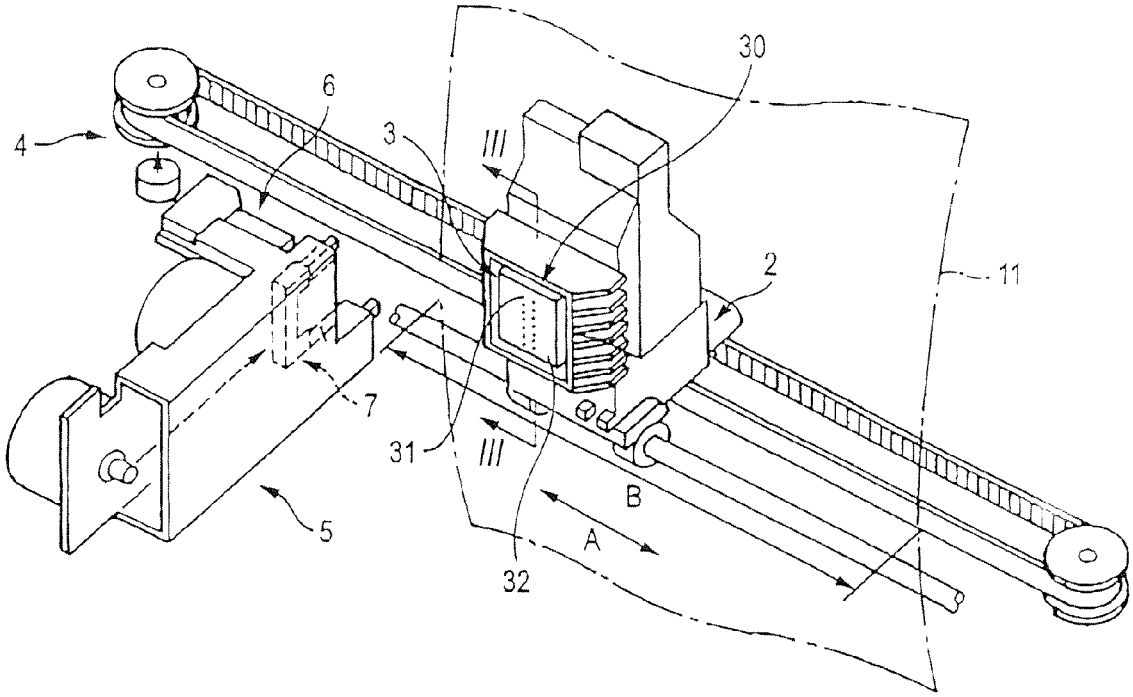
FIG. 2 is a perspective view of a primary portion of the apparatus illustrated in FIG. 1.
Figure 3:
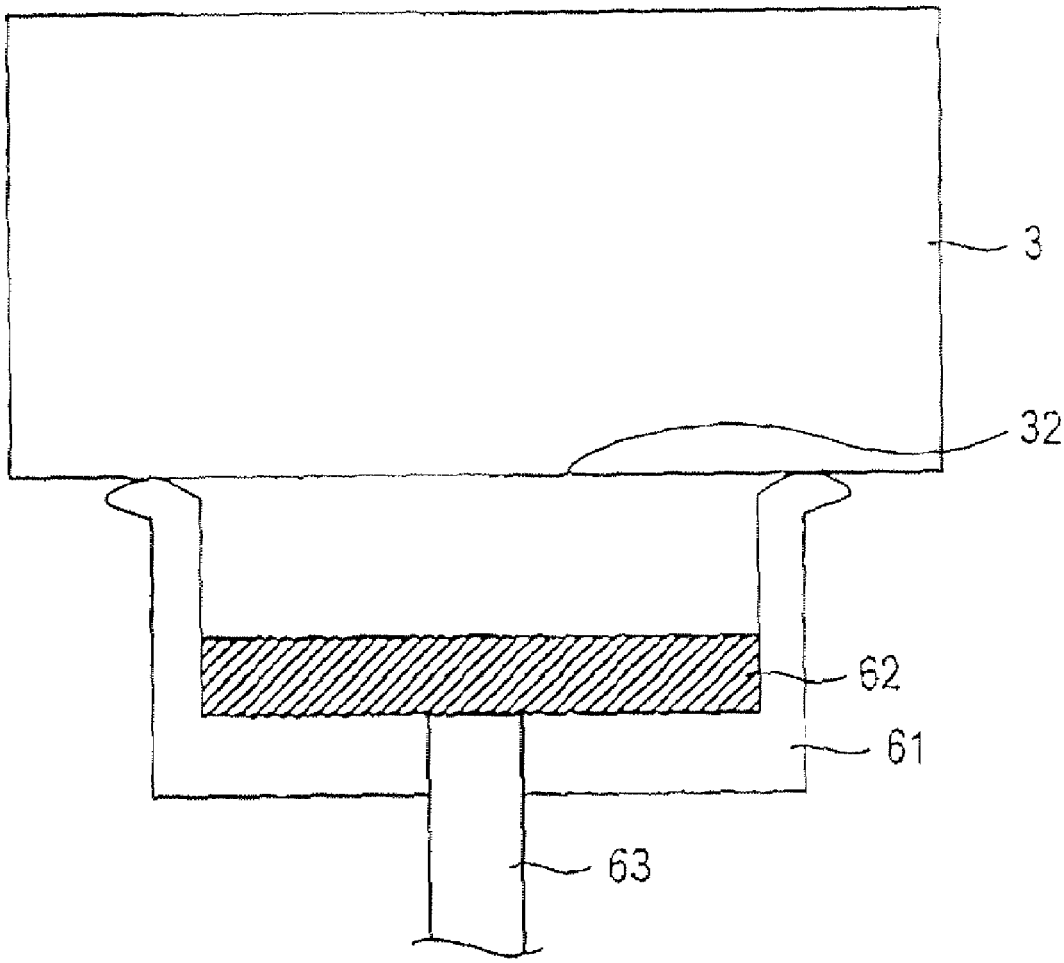
FIG. 3 is a cross-sectional view of a recording head and a cap during cleaning, taken along a line III-III of FIG. 2.
Figure 4:
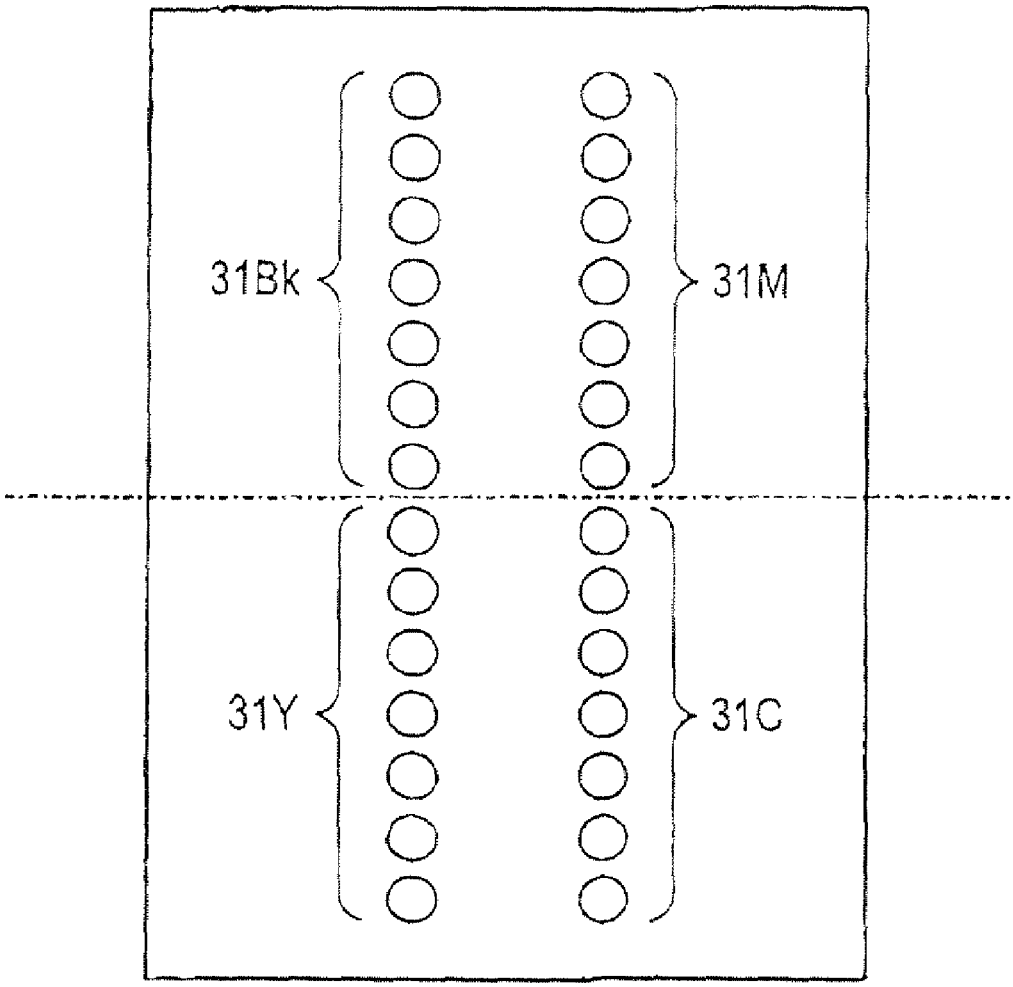
FIG. 4 is a view schematically illustrating a nozzle face.

FIG. 1 is a perspective view of the ink jet recording apparatus to which the invention is applied. FIG. 2 is a perspective view of a primary portion of the apparatus illustrated in FIG. 1, as viewed from the opposite side. FIG. 3 is a cross-sectional view of a recording head and a cap during cleaning, taken along a line III-III of FIG. 2. FIG. 4 is a view schematically illustrating a nozzle face.

As illustrated in these drawings, an ink jet recording apparatus 1 has a recording head 3 in which ink of the invention is filled and which ejects ink droplets; a carriage 2 on which the recording head 3 is mounted; and an actuation mechanism 4 for moving the carriage 2 in a scanning direction indicated by an arrow A.

The recording head 3 has a rectangular nozzle face 32 in which are formed a plurality of nozzles 31 through which ink is ejected. Water-repellent coating is applied on the nozzle face 32, thereby forming a water-repellent film on the surface. Ink droplets are ejected through the nozzles 31 of the recording head 3 while the carriage 2 is moved in the scanning direction A. A recording paper 11 is transported to a position opposing the nozzle face 32, and recording is performed on the surface of the recording paper 11 with the thus-ejected ink droplets.

In relation to the above, a head maintenance mechanism 5 is disposed at a position opposing a home position of the carriage 2, indicated by an arrow C. The head maintenance mechanism 5 has an ink suction mechanism 6 and a head-wiping mechanism 7. The ink suction mechanism 6 comprises a cap 61, an inner absorptive member 62, an ink tube 63, and the like. The ink suction mechanism 6 is provided for covering the nozzle face 32 of the recording head 3 with the cap 61, sucking the ink by way of the ink tube 63, and sending the ink to a waste liquid retaining portion (not shown) through the inner absorptive member 62, when cleaning is to be performed. The head-wiping mechanism 7 is provided for wiping ink, paper dust, dust, and the like, which adhere to the nozzle face 32 and to a nozzle protection surface formed on the carriage 2, by use of a wiper 71 held by the ink-wiping mechanism 7, when the carriage 2 has retreated to a home position C from a recording region B.

Configuration of Nozzles in Recording Head

As illustrated in FIG. 4, the nozzles 31 are perforated in the nozzle face 32 of the recording head 3. There are formed nozzle groups for ejecting ink of four types: yellow, magenta, cyan, and black. The water-repellent film is formed on the surface of the nozzle face 32. The nozzle groups are constituted of nozzle groups 31Y, 31M, 31C, and 31Bk, in each of which nozzles, through which an ink of a single color is ejected, are arranged in a vertical direction. The nozzle groups are arranged so that 31M and 31Bk are on the upper side and 31C and 31Y are on the lower side. The nozzles are formed in columns. When, e.g., the nozzles are arranged forming a longitudinal single column at a density of 360 dpi (dots per inch) with 64 nozzles, each color is ejected through 32 nozzles on the upper side and another 32 nozzles on the lower side.

Water-Repellent Film on Nozzle Surface

Examples of a method for forming a water-repellent film on the nozzle face 32 of the recording head include: a method of coating a material, such as silicon, glass, a metal, and a resin, forming the nozzle face, with a silicon-based water repellent, a fluorine-based water repellent, or the like; a method of coating the same with a fluorine compound or a silane compound by means of plasma polymerization, thermal deposition, vacuum deposition, or the like; and a method of dipping a member forming the nozzle face, such as a nozzle plate, into an electrolyte, in which metal ions of an appropriately selected metal, such as nickel, copper, or silver, and water-repellent polymer resin particles are dispersed, to thus perform eutectoid plating. Any method among the above can be employed. Water-repellent films of an example and a comparative example are formed by means of depositing a fluorine-containing silane coupling compound by means of vacuum deposition.

Cleaning Operation

The cleaning operation in the ink jet recording apparatus 1 will now be described. The cap 61 is brought into close contact with the nozzle face 32 so as to cover the nozzles 31. Thereafter, an ink suction pump sucks ink remaining in an ink supply path. As a result of suction, ink adheres to the nozzle face. A wiping operation is performed so as to wipe off the ink adhering to the nozzle face. The cap 61 is removed from the nozzle face 32, and thereafter the wiper 71 wipes the nozzle face 32 to thus wipe off the ink. When the ink adhering to the nozzle face 32 as a result of the wiping operation is pressed into the nozzles 31, color mixing occurs. The cap 61 is brought into close contact with the nozzle face 32 so as to cover the nozzles 31 again, and the color-mixed ink is ejected into the cap 61 (the flushing operation). By means of ejecting the ink to thus discharge the same, the color mixing is resolved. As a result, ink meniscuses are formed, and microbubbles are discharged.

In the present invention, a characteristic of water repellency can be evaluated by means of placing an ink droplet on the nozzle face or the surface of a material forming the cap, and measuring its contact angle. In the present invention, the evaluation is conducted by means of measuring a static contact angle of an ink droplet, one minute after the ink has been dropped, at 25° C. The static contact angle is obtained by means of measuring an angle between a surface of a sample (a target of measurement) and an end face at which the ink contacts the surface of the sample. The present embodiment adopts values measured in accordance with a sessile drop method with use of an automatic contact angle meter, CA-X (tradename, manufactured by Kyowa InterFACE Science Co., Ltd.).

EXAMPLES

The present invention will be illustrated in greater detail with reference to the following Examples, but the invention should not be construed as being limited thereto.

Composition of Ink

Composition of ink: yellow ink Y, magenta ink M, cyan ink C, and black ink Bk, for use in illustrating an example of the present invention, and compositions of ink: yellow ink CY, magenta ink CM, cyan ink CC, and black ink CBk, for use in illustrating a comparative example, were respectively manufactured as follows. The respective components were weighed in accordance with the following composition ratios, and mixed. Each of the mixtures was stirred for one hour at room temperature, to thus be sufficiently dissolved. Thereafter, the mixture was filtrated though a membrane filter of 0.8 μm, thereby obtaining water-soluble ink for ink jet recording. The content of each composition of the respective ink is represented in terms of % by weight in relation to the total weight of the ink. Surfynol 82, Surfynol 465, and Olfine STG are tradenames of surfactants manufactured by Nisshin Chemical Industry Co., Ltd. Proxel XL-II is a tradename of an antiseptic agent manufactured by Arch Chemicals, Inc.

| Yellow Ink Y | <Composition Ratio> |
|---|---|
| C.I. direct yellow 132 | 3.0 |
| diethylene glycol monobutyl ether | 5.0 |
| glycerine | 12.0 |
| Surfynol 82 | 3.0 |
| Surfynol 465 | 0.4 |
| Proxel XL-II | 0.3 |
| ultrapure water | 76.3 |
| total | 100 |

| Magenta Ink M | <Composition Ratio> |
|---|---|
| C.I. acid red 289 | 3.0 |
| 2-pyrrolidone | 8.0 |
| glycerine | 10.0 |
| Surfynol 82 | 3.0 |
| Surfynol 465 | 0.5 |
| Proxel XL-II | 0.3 |
| ultrapure water | 75.2 |
| total | 100 |

| Cyan Ink C | <Composition Ratio> |
|---|---|
| C.I. direct blue 199 | 3.5 |
| diethylene glycol monobutyl ether | 8.0 |
| glycerine | 11.0 |
| Surfynol 82 | 2.5 |
| Surfynol 465 | 0.3 |
| Proxel XL-II | 0.3 |
| ultrapure water | 77.4 |
| total | 100 |

| Black Ink Bk | <Composition Ratio> |
|---|---|
| C.I. direct black 154 | 4.0 |
| 2-pyrrolidone | 8.0 |
| glycerine | 10.0 |
| Surfynol 82 | 2.5 |
| Surfynol 465 | 0.3 |
| Proxel XL-II | 0.4 |
| ultrapure water | 74.8 |
| total | 100 |

| Yellow Ink CY | <Composition Ratio> |
|---|---|
| C.I. direct yellow 132 | 3.5 |
| 2-pyrrolidone | 7.0 |
| glycerine | 14.0 |
| Olfine STG | 0.3 |
| Surfynol 82 | 1.0 |
| Proxel XL-II | 0.3 |
| ultrapure water | 73.9 |
| total | 100 |

| Magenta Ink CM | <Composition Ratio> |
|---|---|
| C.I. acid red 289 | 3.5 |
| diethylene glycol monobutyl ether | 6.5 |
| glycerine | 15.0 |
| Surfynol 465 | 0.3 |
| Proxel XL-II | 0.3 |
| ultrapure water | 74.4 |
| total | 100 |

| Cyan Ink CC | <Composition Ratio> |
|---|---|
| C.I. direct blue 199 | 3.5 |
| diethylene glycol monobutyl ether | 8.0 |
| glycerine | 11.0 |
| Surfynol 465 | 0.3 |
| Proxel XL-II | 0.3 |
| ultrapure water | 76.9 |
| total | 100 |

| Black Ink CBk | <Composition Ratio> |
|---|---|
| C.I. direct black 154 | 4.0 |
| 2-pyrrolidone | 8.0 |
| glycerine | 12.0 |
| Olfine STG | 0.3 |
| Proxel XL-II | 0.3 |
| ultrapure water | 75.4 |
| total | 100 |

Table 1 shows contact angles of the ink Y, M, C, and Bk for use in illustrating the example, where a contact angle of the respective ink in relation to the nozzle face of the recording head of the invention is expressed by θa, and a contact angle of the same in relation to a cap (formed from butyl rubber) of the head maintenance mechanism is expressed by θb. Similarly, Table 2 shows contact angles of the ink CY, CM, CC, and CBk for use in illustrating the comparative example. The contact angles were measured with use of an automatic contact angle meter CA-V (trade name, manufactured by Kyowa InterFACE Science Co., Ltd.) 60 seconds after ink was dropped at 25° C. Examples of a material for the cap other than that used in the present example include foamed rubbers, such an NBR rubber and a silicone rubber. However, the material is not limited thereto.

Next, each of the ink of four colors for use in illustrating the example and the other ink of four colors for use in illustrating the comparative example were brought into conditions at which each ink could be recorded with a recording apparatus. When the cleaning operation was performed, color mixing occurred on the nozzle face 32. Flushing, a final step of the cleaning operation, was performed so as to eject ink onto a recording medium, rather than into a cap, thereby visualizing the result of flushing as a record. Recording was performed with use of a pattern which enables ascertainment of a recording result by a single ejection. The number of shots (flushing operations) performed until the color mixing became unrecognizable was checked. Table 3 shows the results of measurements of 100 shots, consisting of 50 shots under a recording environment of 5° C., and 50 shots under an environment of 40° C.

TABLE 1

| | Yellow Ink Y | Magenta Ink M | Cyan Ink C | Black Ink Bk |
|---|---|---|---|---|
| θa | 82 | 75 | 73 | 79 |
| θb | 30 | 24 | 25 | 31 |
| θa − θb | 52 | 51 | 48 | 48 |

TABLE 2

| | Yellow Ink CY | Magenta Ink CM | Cyan Ink CC | Black Ink CBk |
|---|---|---|---|---|
| θa | 80 | 78 | 73 | 75 |
| θb | 43 | 48 | 42 | 40 |
| θa − θb | 37 | 30 | 31 | 35 |

TABLE 3

| | Number of flushing operations until color mixture became unrecognizable (shots) | | | |
|---|---|---|---|---|
| | 5,000 or less | 5,001 to 10,000 | 10,001 to 15,000 | 20,001 or more |
| Example | 10 | 49 | 37 | 0 |
| Comparative Example | 0 | 7 | 38 | 15 |

The effects of the above embodiment are as follows.

Table 1 shows that the contact angles θa of the respective ink for use in illustrating the example in relation to the water-repellent film are larger than the contact angles θb of the same in relation to the cap, and that each of the angles θa is 50° or larger, and each of the differences between the angles θa and θb is 40° or larger. Table 2 shows that the respective inks for use in illustrating the comparative example exhibit a difference between the angles θa and θb smaller than 40°. Table 3 shows that, by means of the configuration of the example, color mixing becomes unrecognizable until the number of shots reaches 15,001 to 20,000 at most, where the number of shots until the color mixing becomes unrecognizable most frequently falls within the range of 5,001 to 10,000. In contrast, by means of the configuration of the comparative example, color mixing is observed even when the number of shots is 20,001 or more, and the number of shots until the color mixing becomes unrecognizable s falls most frequently within the range of 15,001 to 20,000. According to the example, the ink is more wettable with respect to the cap than with respect to the nozzle face, and the difference in the degree of wettability is sufficiently large. Accordingly, the ink readily moves from the nozzle face to the cap at the time of ink suction in the cleaning operation, and substantially no ink remains on the nozzle face. Therefore, even when wiping is performed, color mixing occurs to a smaller extent. More specifically, according to the example, during cleaning of an ink jet recording head through which inks of a plurality of colors are to be ejected, color mixing on the nozzle face occurs to a smaller extent, and the number of shots required for flushing can be set to a smaller number. By virtue of setting the number of flushing to a smaller number, an amount of ink for use in recording can be increased, thereby lowering running cost.

In the ink jet recording apparatus of the invention, the extent of color mixing is ascertained to be small in advance when the angle θa is 50° or larger, and the difference between the angles θa and θb is 40° or larger. Therefore, the number of required flushing operations can be readily predicted, thereby obviating provision of an excessive margin in setting of the number of flushing operations to be performed subsequent to wiping. Furthermore, ink can be wiped sufficiently even when a load applied on the wiper during wiping is small. Therefore, the durability of the ink-repellent film on the nozzle face is increased, thereby prolonging the useful life of the recording head. Furthermore, the ink moves from the nozzle face into the cap without use of means, such as increasing clearances between nozzle groups of different colors, and application of a special treatment to the absorptive member within the cap. Therefore, special treatment is not required for implementation of cleaning, thereby avoiding an increase in cost related to cleaning.

While the present invention has been described in detail and with reference to specific embodiments thereof, it will be apparent to one skilled in the art that various changes and modifications can be made therein without departing from the spirit and scope thereof.

This application is based on Japanese Patent Application No. 2004-318818 filed Nov. 2, 2004, the contents thereof being herein incorporated by reference.

What is claimed is:

1. An ink jet recording apparatus having an ink jet recording head provided with a plurality of nozzles through which inks of a plurality of colors are ejected, a cap to be detachably brought into close contact with a nozzle face in which holes of said plurality of nozzles are formed, and ink suction means which sucks an ink within said ink jet recording head by way of said cap, wherein contact angles θa of said inks with respect to said nozzle face and contact angles θb of said inks with respect to said cap have a relation of θa<θb; and said angles θa are 50° or larger, and differences between said angles θa and said angles θb are 40° or larger.

2. The ink jet recording apparatus according to claim 1, comprising each of a yellow ink, a magenta ink, a cyan ink and a black ink.

3. The ink jet recording apparatus according to claim 1, wherein the differences between said angles θa and said angles θb do not exceed 52°.

* * * * *